US010352614B2

(12) United States Patent
Platts

(10) Patent No.: US 10,352,614 B2
(45) Date of Patent: Jul. 16, 2019

(54) REFRIGERATOR APPLIANCE HAVING A DISPENSING ASSEMBLY

(71) Applicant: Haier US Appliance Solutions, Inc., Wilmington, DE (US)

(72) Inventor: Lauren Nicole Platts, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 75 days.

(21) Appl. No.: 15/663,918

(22) Filed: Jul. 31, 2017

(65) Prior Publication Data

US 2019/0032992 A1 Jan. 31, 2019

(51) Int. Cl.

| | |
|---|---|
| ***F25D 23/02*** | (2006.01) |
| ***F25D 23/12*** | (2006.01) |
| ***F25D 25/02*** | (2006.01) |
| ***F25D 31/00*** | (2006.01) |
| ***F25C 5/20*** | (2018.01) |
| *F28D 1/02* | (2006.01) |

(52) U.S. Cl.

CPC ..... *F25D 23/126* (2013.01); *F25C 5/22* (2018.01); *F25D 23/028* (2013.01); *F25D 25/025* (2013.01); *F25D 31/005* (2013.01); *F25D 2323/021* (2013.01); *F28D 1/0213* (2013.01); *F28F 2265/14* (2013.01)

(58) Field of Classification Search

CPC ..... F25D 23/028; F28D 20/02; F28D 1/0213; F28F 2255/16; F28F 2265/14; F25C 2400/10; F25C 5/22; F25C 2400/12; F24C 7/08

See application file for complete search history.

(56) References Cited

U.S. PATENT DOCUMENTS

| | | | | |
|---|---|---|---|---|
| D518,076 | S | 3/2006 | Quinlan et al. | |
| 7,610,849 | B2 | 11/2009 | Bigge et al. | |
| 7,748,570 | B2 * | 7/2010 | Bordino | B67D 3/0022 222/146.1 |
| 8,377,292 | B2 | 2/2013 | Patera et al. | |
| 9,352,950 | B2 | 5/2016 | Berger et al. | |
| D765,744 | S | 9/2016 | Park et al. | |
| 9,568,240 | B2 * | 2/2017 | Hall | B67D 7/82 |
| 2017/0057803 | A1 * | 3/2017 | McKinney | F25D 23/12 |
| 2017/0167780 | A1 * | 6/2017 | Jeong | B67D 1/0014 |

FOREIGN PATENT DOCUMENTS

| | | | |
|---|---|---|---|
| KR | 100745177 | B1 | 8/2009 |
| KR | 1020100097466 | A | 9/2010 |

* cited by examiner

*Primary Examiner* — Frantz F Jules

*Assistant Examiner* — Lionel Nouketcha

(74) *Attorney, Agent, or Firm* — Dority & Manning, P.A.

(57) ABSTRACT

A refrigerator appliance having a dispensing assembly is provided herein. The refrigerator appliance may include a cabinet, a door rotatably mounted to the cabinet, and the dispensing assembly. The dispensing assembly may include a dispenser recess and an outlet conduit. The dispenser recess may be defined along an outer surface of the door and extend in a lateral direction from a first side portion to a second side portion of the door. The outlet conduit may be in selective fluid communication with the dispenser recess to direct a fluid thereto.

17 Claims, 6 Drawing Sheets

REFRIGERATOR APPLIANCE HAVING A DISPENSING ASSEMBLY

FIELD OF THE INVENTION

The present subject matter relates generally to refrigerator appliances, and more particularly to refrigerator appliances having a dispensing assembly.

BACKGROUND OF THE INVENTION

Refrigerator appliances generally include a cabinet that defines a chilled chamber for receipt of food articles for storage. The refrigerator appliances can also include a dispenser mounted to a single door for directing ice from the refrigerator's ice maker and/or liquid water to the dispenser. A user can activate the dispenser to direct a flow of ice or liquid water into a cup or other container positioned below the dispenser. Liquid water directed to the dispenser is generally chilled or at an ambient temperature. Further refrigerator appliances can also include features for dispensing heated liquid water. The heated liquid water can be used to make certain beverages, such as coffee or tea. Refrigerators equipped to dispense heated liquid water can assist with making such beverages. Further, in some cases, refrigerator appliances may be equipped to provide single serving beverages using single serving dispensers and heated liquid water.

However, challenges exist with typical refrigerator appliances. As an example, the area for a dispenser is generally limited. Specifically, the area to receive cups or containers below the dispenser is often limited to a small sub-portion of a single door. Moreover, the ability of the dispenser to provide or dispense various fluids or products is further limited by the designated area. As an example, it can be difficult to provide elements for dispensing multiple products (e.g., ice, water, etc.) within a limited area of a single door. Although certain elements, may be spaced away from the dispenser to be directed thereto later (e.g., as instructed by a user), such features will generally complicate assembly and use of the appliance. Moreover, such configurations may delay the delivery of desired fluids and/or products.

Depending on the location of the dispenser, difficulties may also arise in delivering products of vastly different temperatures. For instance, in the case of a side-by-side refrigerator appliance, a dispenser is often provided on a freezer door selectively covering the freezer compartment. However, if heated water or fluids are desired, an appliance may have difficulty preventing large temperature variations within the freezer compartment. Similarly, the dispenser is provided on a refrigerator door selectively covering the fresh food compartment, an appliance may have difficulty preventing large temperature variations within the fresh food compartment during the storage and delivery of ice or chilled water.

Accordingly, improved refrigerator appliances are desired in the art. In particular, refrigerator appliances that provide improved dispensing assemblies for the delivery of one or more products would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet, a door rotatably mounted to the cabinet, and a dispensing assembly. The cabinet may extend along a lateral direction from a first side portion to a second side portion. The cabinet may define a chilled chamber between the first side portion and the second side portion. The door may pivot between a closed position restricting access to the chilled chamber and an open position permitting access to the chilled chamber. The dispensing assembly may include a dispenser recess and an outlet conduit. The dispenser recess may be defined along an outer surface of the door and extend in the lateral direction from the first side portion to the second side portion. The outlet conduit may be in selective fluid communication with the dispenser recess to direct a fluid thereto.

In another aspect of the present disclosure, a refrigerator appliance is provided. The refrigerator appliance may include a cabinet, a first door, a second door, and a dispensing assembly. The cabinet may extend along a lateral direction from a first side portion to a second side portion. The cabinet may define a freezer chamber and a fresh food chamber between the first side portion and the second side portion. The first door may be rotatably mounted to the cabinet to pivot between a closed position restricting access to the freezer chamber and an open position permitting access to the freezer chamber. The second door may be rotatably mounted to the cabinet to pivot between a closed position restricting access to the fresh food chamber and an open position permitting access to the fresh food chamber. The dispensing assembly may include a dispenser recess and an outlet conduit. The dispenser recess may be defined along an outer surface of the first door and an outer surface of the second door. The dispenser recess may extend in the lateral direction from the first side portion to the second side portion. The outlet conduit may be in selective fluid communication with the dispenser recess to direct a fluid thereto.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
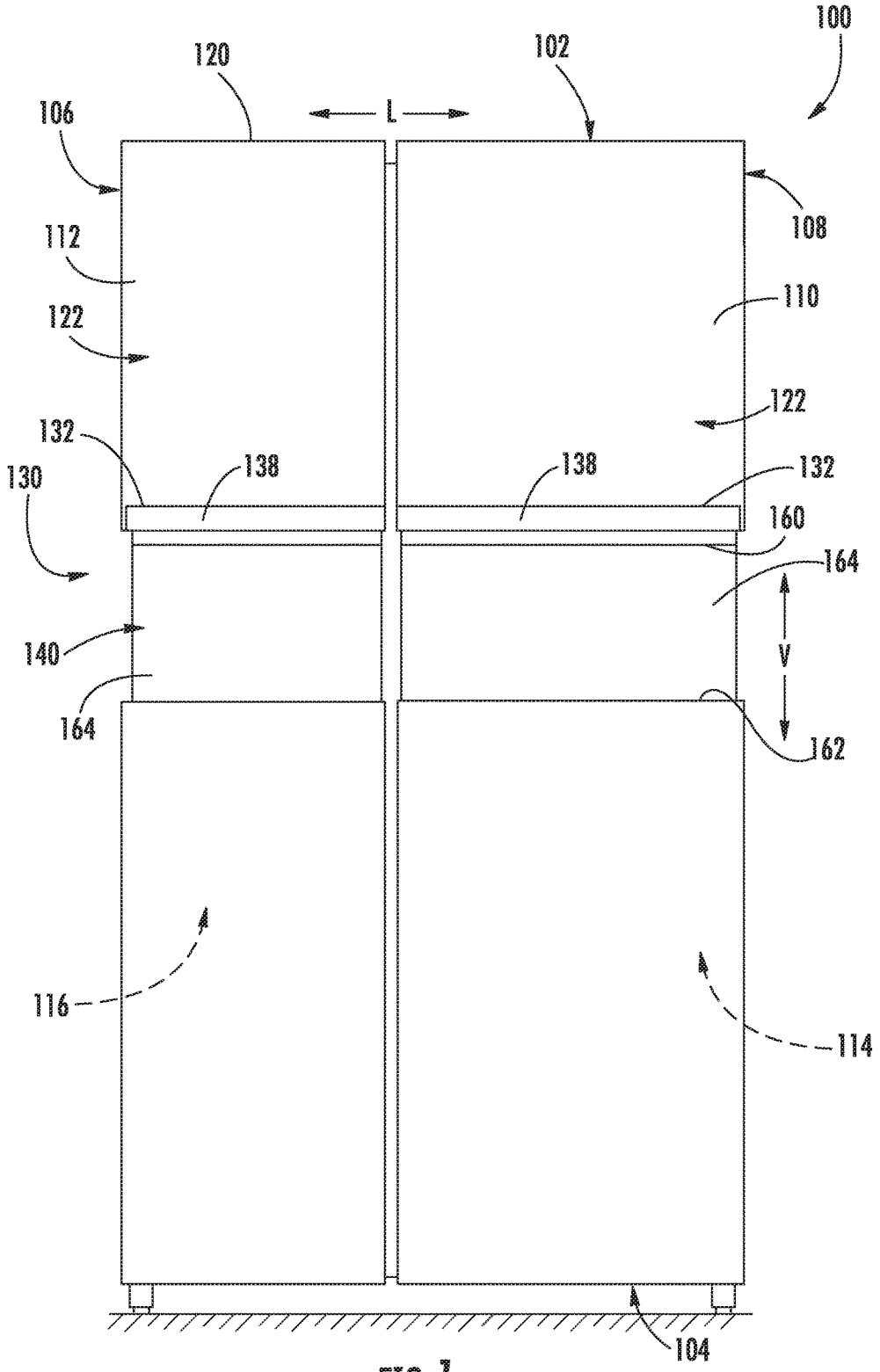
FIG. 1 provides a front perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components.

Figure 2:
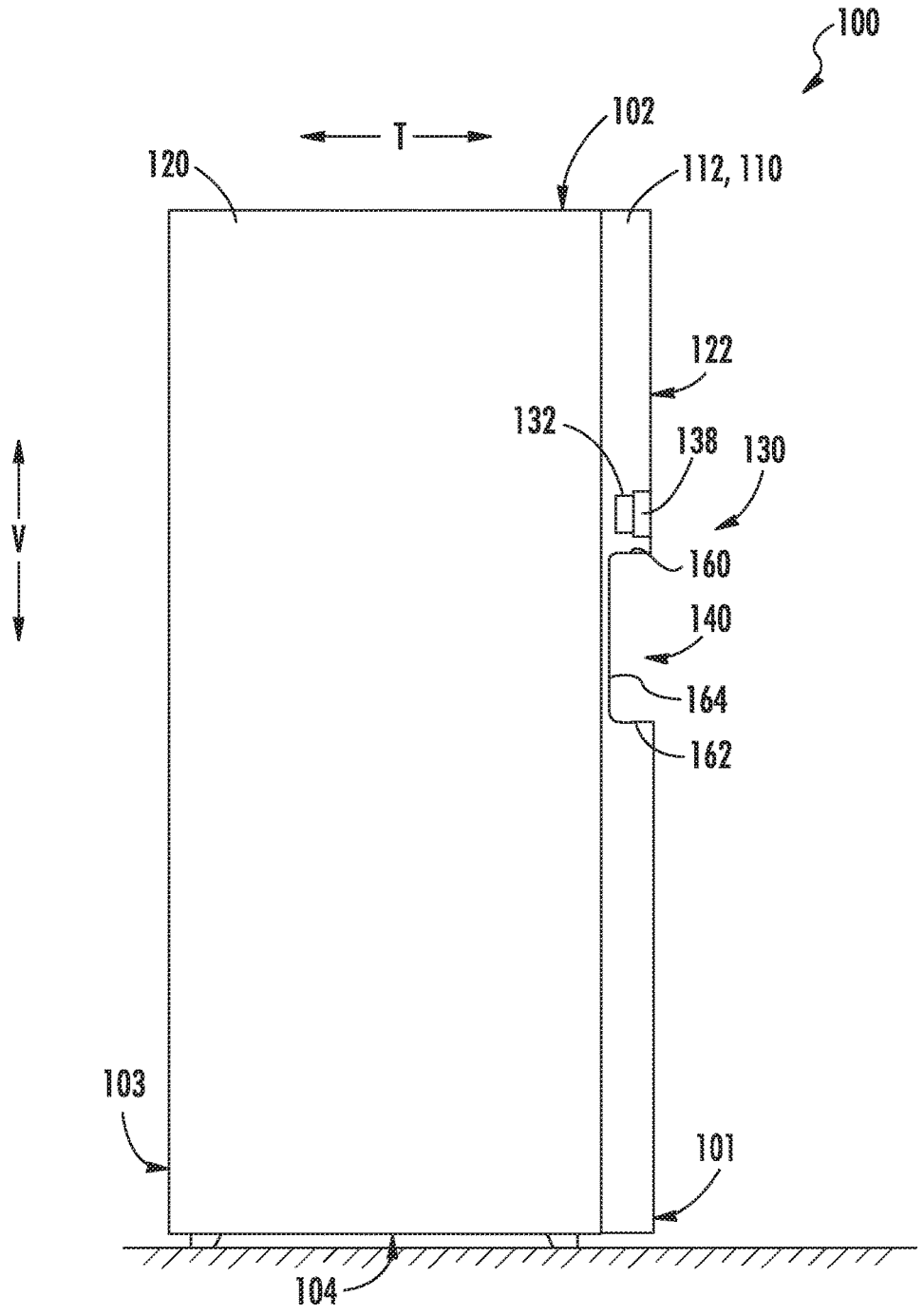
FIG. 2 provides a side view of the exemplary refrigerator appliance of FIG. 1.
Figure 3:
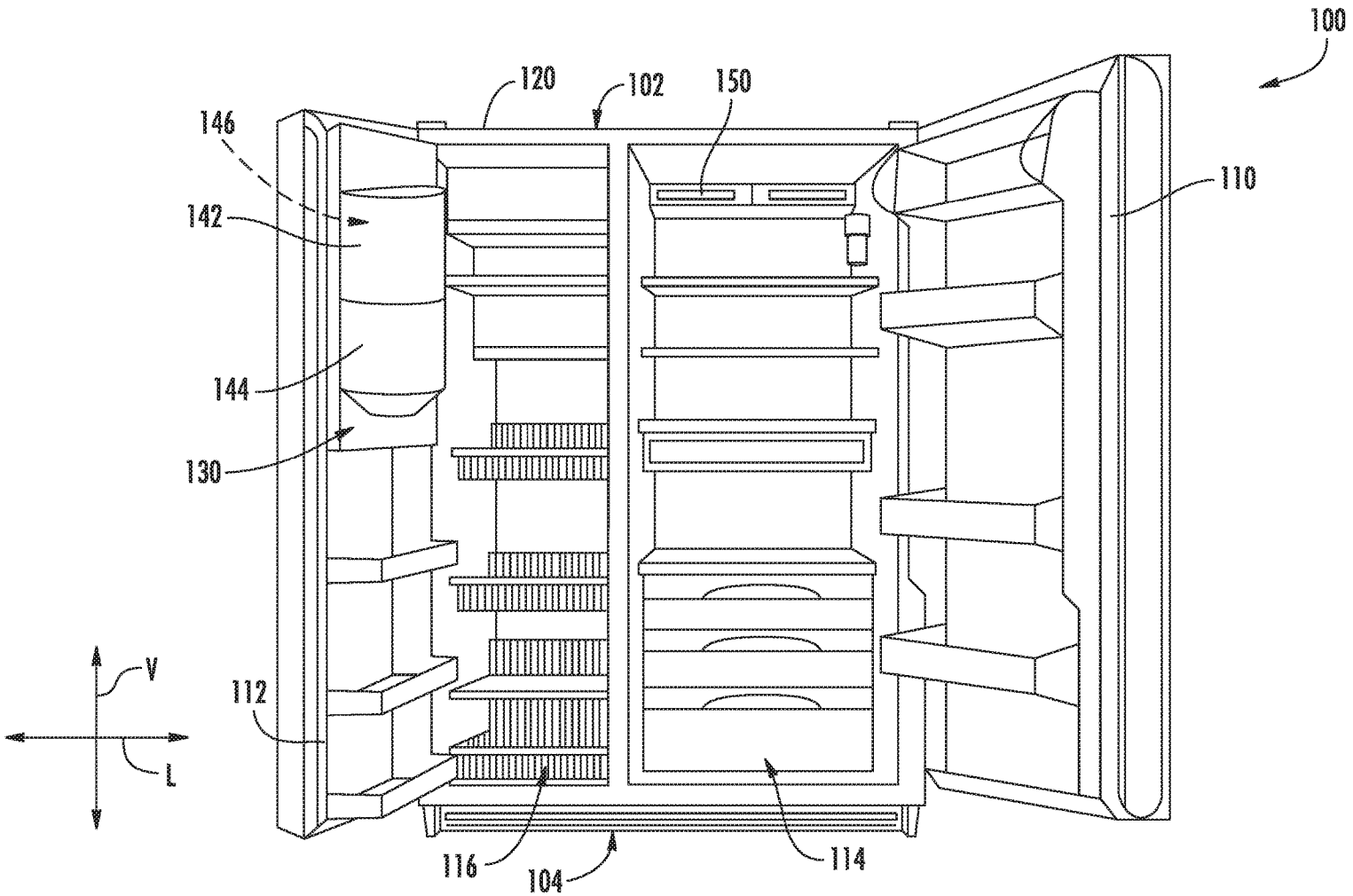
FIG. 3 provides a front perspective view of the exemplary refrigerator appliance of FIG. 1, wherein the doors are shown in an open position.

Turning now to the figures, FIG. 1 provides a front, perspective view of a refrigerator appliance 100 according to an exemplary embodiment of the present disclosure. FIG. 2 provides a side perspective view of refrigerator appliance 100. FIG. 3 provides a front, perspective view of refrigerator appliance 100 with a refrigerator door 110 and a freezer door 112 of refrigerator appliance 100 shown in an open position to reveal a fresh food chamber 114 and a freezer chamber 116 of refrigerator appliance 100.

As shown, refrigerator appliance 100 defines a vertical direction V, a lateral direction L, and a transverse direction T. The vertical direction V, lateral direction L, and transverse direction T are mutually perpendicular and form an orthogonal direction system. Refrigerator appliance 100 extends between an upper portion 102 and a lower portion 104 along the vertical direction V. Refrigerator appliance 100 also extends between a first side portion 106 and a second side portion 108, e.g., along the lateral direction L. Furthermore, refrigerator appliance 100 extends between a forward portion 101 and a rear portion 103, e.g., along the transverse direction T.

Refrigerator appliance 100 includes a cabinet 120 that defines chilled chambers for receipt of food items for storage. In some embodiments, refrigerator appliance 100 defines a freezer chamber 116 at first side portion 106 of refrigerator appliance 100 and a fresh food chamber 114 arranged next to fresh food chamber 114 at second side portion 108 of refrigerator appliance 100. As such, the illustrated refrigerator appliance 100 is generally referred to as a side-by-side style refrigerator appliance. However, using the teachings disclosed herein, one of skill in the art will understand that the present subject matter may be used with other types of refrigerator appliances (e.g., bottom mount or top mount style). Consequently, the description set forth herein is for illustrative purposes only and is not intended to limit the present subject matter in any aspect.

In some embodiments, one or more doors 110, 112 are rotatably mounted to cabinet 120. For instance, a freezer door 112 (e.g., first door) may be rotatably hinged to an edge of cabinet 120 proximal to first side portion 106 to selectively permit access to accessing freezer chamber 116. Similarly, a refrigerator door 110 (e.g., second door) may be rotatably hinged to an edge of cabinet 120 proximal to second side portion 108 to selectively permit access to fresh food chamber 114. Refrigerator door 110 and freezer door 112 can each rotate or pivot between an open position (shown in FIG. 2) and a closed position (shown in FIG. 1) in order to permit selective access to fresh food chamber 114 and freezer chamber 116, respectively.

As shown, refrigerator appliance 100 includes a dispensing assembly 130 for receiving one or more containers and dispensing various products (e.g., ice, water, etc.) from refrigerator appliance 100, as will be described in greater detail below. Generally, dispensing assembly 130 includes a dispenser 132 positioned on or mounted to an exterior portion of refrigerator appliance 100, e.g., on doors 110, 112. A dispenser recess 140 is defined in communication with dispenser 132. Specifically, dispenser recess 140 may be defined below dispenser 132 along the vertical direction V. Moreover, dispenser recess 140 may extend along an outer surface 122 of doors 110, 112. The dispenser recess 140 may thus form a void inward from the outer surface 122 of doors 110, 112. Furthermore, as shown, dispenser recess 140 extends in the lateral direction L from the first side portion 106 to the second side portion 108 (i.e., across the entire lateral width of cabinet 120).

Generally, dispenser 132 includes one or more discharge outlets positioned above dispenser recess 140 for accessing various fluids and/or ice. One or more suitable actuators may be used to operate dispenser 132. For example, dispenser 132 can include a paddle or button for operating dispenser 132. Additionally or alternatively, a sensor, such as an ultrasonic sensor, may be mounted to dispenser 132 beneath a discharge outlet for operating dispenser 132, e.g., during an auto-fill process of refrigerator appliance 100. In some embodiments, a control or user interface panel 138 is provided for controlling and/or displaying information regarding a mode of operation. For example, user interface panel 138 may include a plurality of user inputs (not labeled), such as a water dispensing button and an ice-dispensing button, for selecting a desired mode of operation such as crushed or non-crushed ice. Additionally or alternatively, user interface panel 138 may include or more displays to project information regarding operations of appliance 100.

As discussed below, discharge outlets are an external part of dispenser 132. In some embodiments, dispenser recess 140 is positioned at a predetermined elevation convenient for a user to access ice or water and enabling the user to access ice without the need to bend-over and without the need to access freezer chamber 116. In the illustrated embodiment of FIG. 1, dispenser recess 140 is positioned at a level that approximates the chest level of a user. Moreover, dispenser recess 140 is advantageously extended across the entire width of refrigerator appliance 100, eliminating a potential side-by-side pain point and permitting greater access to discharge outlets.

In some embodiments, assembly 130 includes a housing 142 mounted, as an example, on or within door 112. As door 112 opens and closes, housing 142 may be selectively positioned within and out of freezer chamber 116, respectively. Generally, housing 142 is constructed and arranged to facilitate production and storage of ice. In some such embodiments, housing 142 includes or contains an icemaker 146 for creating ice and/or feeding the same to a bin 144 mounted on freezer door 112, e.g., below or beneath housing 142. As illustrated in FIG. 2, bin 144 may be mounted at a vertical position on freezer door 112 that will allow for the receipt of ice from a discharge opening of housing 142 and into an entrance of bin 144. As freezer door 112 is closed or opened, icemaker 146 and bin 144 may be moved together in and out of freezer chamber 116. However, in alternative embodiments, icemaker 146 may be mounted at another suitable position, e.g., at a fixed position within freezer chamber 116.

Operation of the refrigerator appliance 100 can generally be regulated by a controller 150 that is operatively coupled to user interface panel 138. User interface panel 138 may thus provide selections for user manipulation of the operation of refrigerator appliance 100 (e.g., selections between whole or crushed ice, chilled water, heated water, etc.). In response to user manipulation of the user interface panel 138, controller 150 may activate or direct various components of the refrigerator appliance 100. Controller 150 may include a memory (e.g., non-transitory storage media) and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may be positioned in a variety of locations throughout refrigerator appliance 100. In the illustrated embodiment, controller 150 is located at upper portion 102 or refrigerator appliance 100 within fresh food chamber 114. However, in alternative example embodiments, controller 150 may be located within the control panel area of freezer door 112. Input/output ("I/O") signals may be routed between controller 150 and various operational components of refrigerator appliance 100. For example, user interface panel 138 may be in communication with controller 150 via one or more signal lines or shared communication busses.

Figure 4:
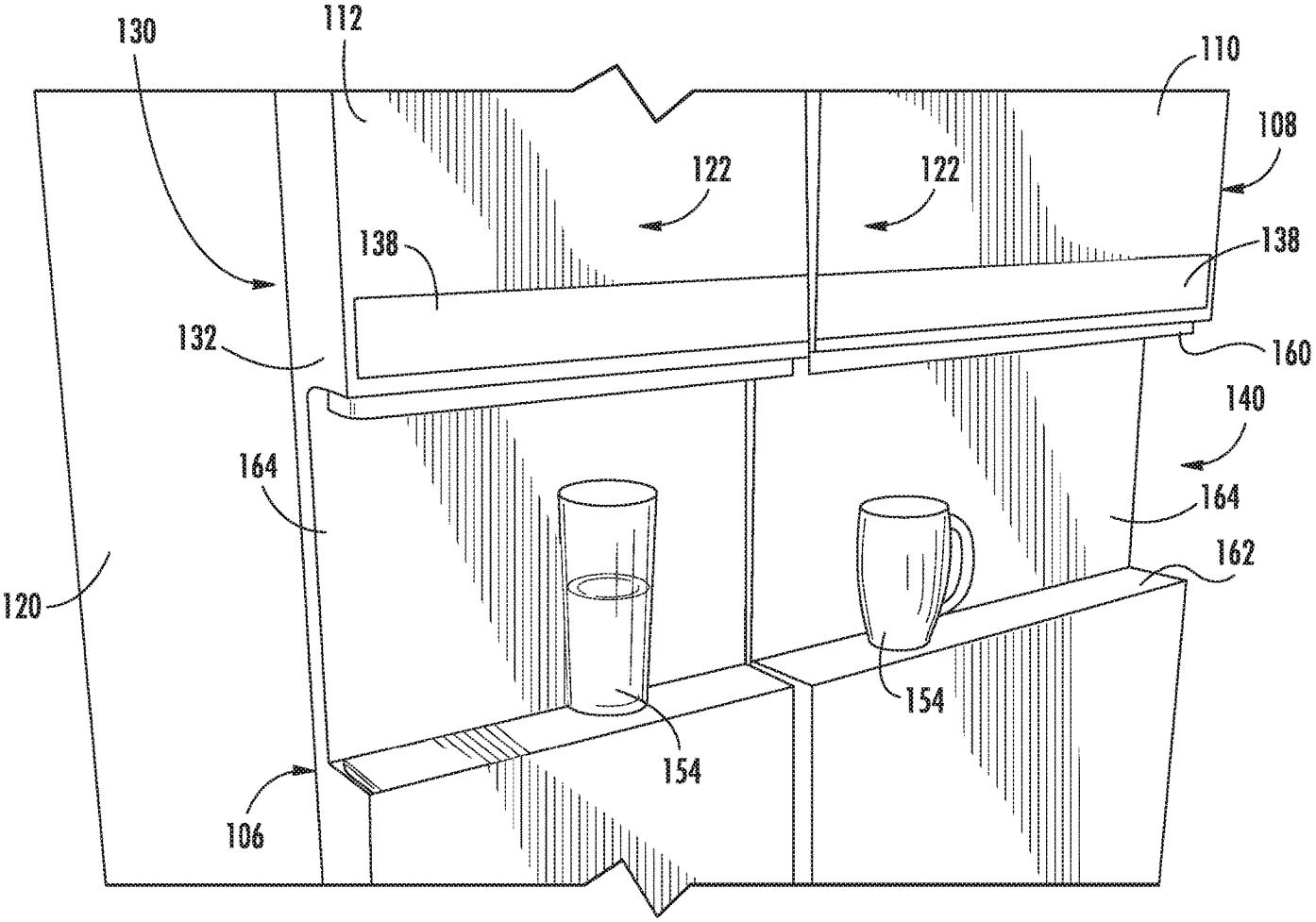
FIG. 4 provides an elevated perspective view of the dispensing assembly of the exemplary refrigerator appliance of FIG. 1.
Figure 5:
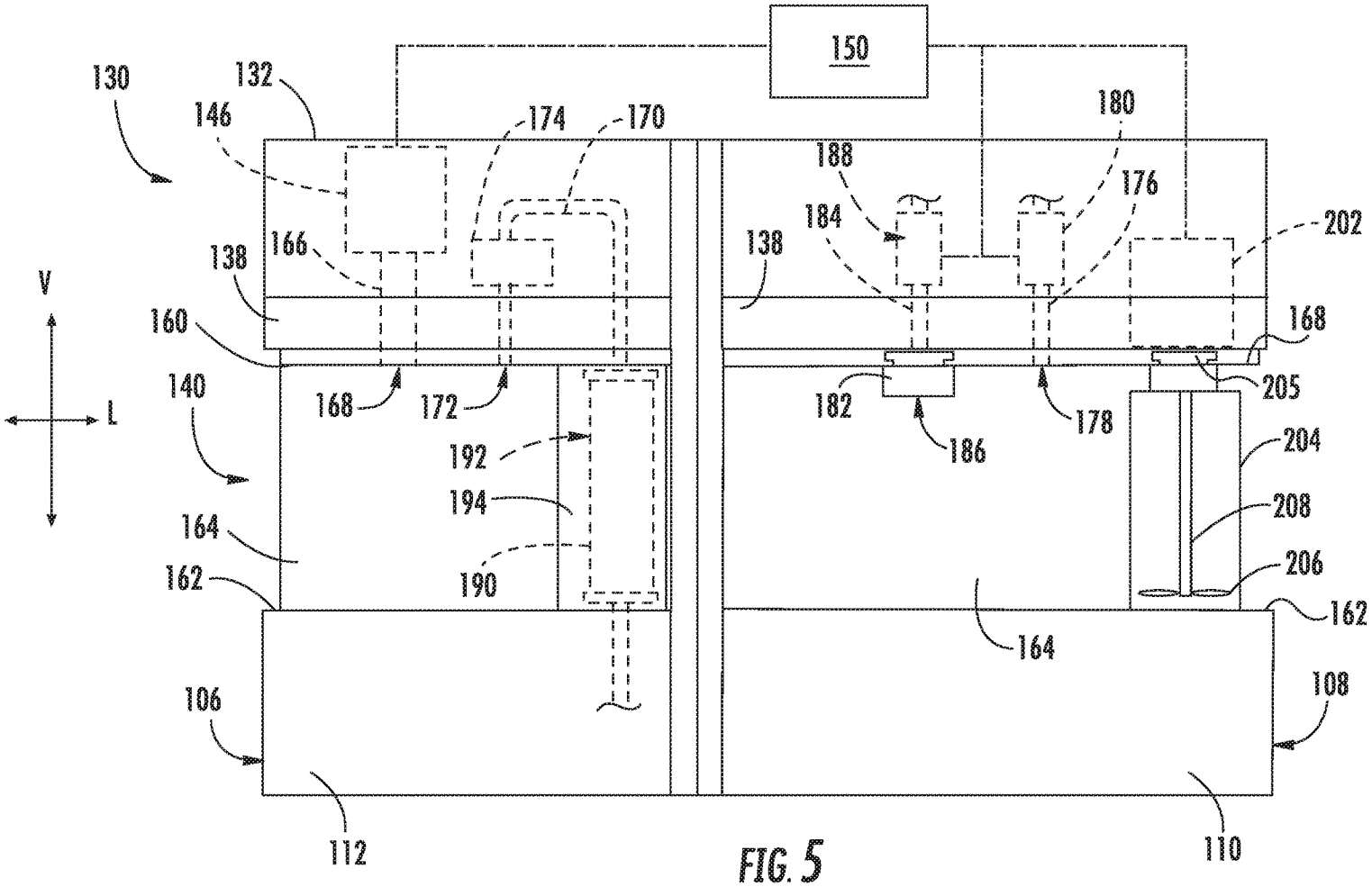
FIG. 5 provides a schematic front view of a dispensing assembly according to exemplary embodiments of the present disclosure.

Turning now to FIGS. 4 and 5, various views of dispensing assembly 130 are shown. Specifically, FIG. 4 provides an elevated front perspective view of dispensing assembly 130, and FIG. 5 provides a front schematic view of dispensing assembly 130. As shown, dispensing assembly 130 defines dispenser recess 140 across the outer surfaces 122 of both freezer door 112 and refrigerator door 110. Specifically, dispenser recess 140 extends along the lateral direction L from first side portion 106 to second side portion 108. A top wall 160 and a bottom wall 162 may define dispenser recess 140 in the vertical direction V. In other words, top wall 160 and bottom wall 162 may define vertical extremum of dispenser recess 140. When assembled, bottom wall 162 may define a surface (e.g., planar or vented surface) for supporting containers 154 placed within dispenser recess 140. Top wall 160 may define and/or support one or more discharge outlets (e.g., outlets 168, 172, 178) of dispensing assembly 130.

A back panel 164 extends in the vertical direction V between top wall 160 and bottom wall 162. Since dispenser recess 140 is defined along the outer surfaces 122 of doors 110, 112, back panel 164 may be offset from the outer surfaces 122 in the transverse direction T. Moreover, back panel 164 may define a transverse extrema of dispenser recess 140. The area of dispenser recess 140 opposite back panel 164 (e.g., relative to the transverse direction T) may be generally open and unrestricted. In turn, various containers 154 (e.g., cups, buckets, bins, etc.) may be easily and advantageously received, removed, and/or supported along the entire width (e.g., distance along the lateral direction L) of dispenser recess 140.

In some embodiments, multiple discrete discharge outlets (e.g., outlets 168, 172, 178) are provided in communication with dispenser recess 140. Discharge outlets may generally be an external part of dispensing assembly 130, and are positioned at or adjacent dispenser recess 140. For instance, the discharge outlets 168, 172, 178 may extend to dispenser recess 140 through top wall 160 from one of the doors 110, 112. Moreover, one or more of the discharge outlets 168, 172, 178 may be spaced apart from each other along the lateral direction L. In turn, discrete locations along the width of dispenser recess 140 may correspond to separate discharge outlets 168, 172, or 178 for delivery of different fluids or products.

In certain embodiments, icemaker 146 is in selective communication with dispensing assembly 130. For instance, an ice chute 166 may extend to dispenser recess 140 and define a chute outlet 168 thereabove. Ice chute 166 may thus extend through top wall 160. In some such embodiments, ice chute 166 extends through freezer door 112 (e.g., from icemaker 146 and/or bin 144—FIG. 3). In turn, when freezer door 112 is in the closed position, ice chute 166 is advantageously held adjacent to freezer chamber 116, proximal to relatively low temperature environment (e.g., an environment below 32° Fahrenheit). During use, ice may be directed from icemaker 146 and/or bin 144 through ice chute 166 and to dispenser recess 140 (e.g., into a removable container 154 positioned directly below chute outlet 168 within dispenser recess 140). Optionally, a suitable chute input or actuator (e.g., paddle, button, and/or sensor) of dispenser 132 may be used to initiate delivery of ice through ice chute 166.

In additional or alternative embodiments, a fluid conduit, such as a chilled water conduit 170 is provided in communication with a water source (not pictured) to selectively dispense a chilled water stream (e.g., below an ambient temperature of dispenser recess 140). At least a portion of chilled water conduit 170 may extend to dispenser recess 140 and define a chilled water outlet 172 thereabove. Chilled water conduit 170 may thus extend through top wall 160. In some such embodiments, chilled water conduit 170 extends through freezer door 112 (e.g., from a distal portion of cabinet 120). In turn, when freezer door 112 is in the closed position, chilled water conduit 170 is advantageously held adjacent to freezer chamber 116, proximal to relatively low temperature environment of cabinet 120 (e.g., an environment below 32° Fahrenheit).

A water valve 174 may be provided along chilled water conduit 170 to control the flow of chilled water therethrough. For instance, water valve 174 may be in operable communication (e.g., electrically coupled) with controller 150. During use, water may be flowed (e.g., as directed by controller 150) from the water source to dispenser recess 140 (e.g., into a removable container 154 positioned directly below chilled water outlet 172 within dispenser recess 140). Optionally, a suitable chilled water input or actuator (e.g., paddle, button, and/or sensor) of dispenser 132 may be used to initiate delivery of chilled water through chilled water outlet 172.

In further additional or alternative embodiments, another fluid conduit, such as a heated water conduit 176 is provided in communication with a water source and/or water heater assembly (not pictured) to selectively dispense a heated water stream (e.g., at or above an ambient temperature of dispenser recess 140). At least a portion of heated water conduit 176 may extend to dispenser recess 140 and define a heated water outlet 178 thereabove. Heated water conduit 176 may thus extend through top wall 160. In some such embodiments, heated water conduit 176 extends through refrigerator door 110 (e.g., from a distal portion of cabinet 120). In turn, when refrigerator door 110 is in the closed position, heated water conduit 176 is advantageously held adjacent to fresh food chamber 114, proximal to a relatively high temperature environment of cabinet 120 (e.g., an environment above 32° Fahrenheit). In some such embodiments, features for the water heater assembly, such as a resistive heating element, may be positioned within a portion refrigerator appliance 100 in thermal communication with heated water conduit 176 (e.g., mounted within refrigerator door 110).

A water valve 180 may be provided along heated water conduit 176 to control the flow of heated water therethrough. For instance, water valve 180 may be in operable communication (e.g., electrically coupled) with controller 150. During use, water may be flowed (e.g., as directed by controller 150) from the water source to dispenser recess 140 (e.g., into a removable container 154 positioned directly below heated water outlet 178 within dispenser recess 140). Water may thus exit refrigerator appliance 100 at heated water outlet 178 as heated liquid water or steam (i.e., as a fluid having a temperature greater than that of water within chilled water conduit 170). Optionally, a suitable heated water input or actuator (e.g., paddle, button, and/or sensor) of dispenser 132 may be used to initiate delivery of heated water through heated water outlet 178.

In some embodiments, both chilled water conduit 170 and heated water conduit 176 have a discrete respective outlet 172, 178 in dispensing assembly 130. As shown, each water conduit 170, 176 and outlet 172, 178 may be spaced apart (e.g., in the lateral direction L). During use, water may be selectively and independently delivered from each water conduit 170, 176.

In optional embodiments, a brew module 182 may be provided to receive a brew pod (not pictured) or other suitable vessel which contains or is fillable with a predetermined amount of brewing contents (e.g., coffee, tea, hot chocolate, lemonade, etc.). As shown, brew module 182 may be in fluid communication with a brew conduit 184 to receive water (e.g., heated water) from a water source and/or heated water assembly (not pictured). A brew outlet 186 may be defined in a bottom portion of brew module 182 to release a brewed beverage from brew module 182 to dispenser recess 140 (e.g., into a removable container 154 positioned directly below brew outlet 186 within dispenser recess 140). In some such embodiments, brew conduit 184 extends through refrigerator door 110 (e.g., from a distal portion of cabinet 120). In turn, when refrigerator door 110 is in the closed position, brew conduit 184 is advantageously held adjacent to fresh food chamber 114, proximal to a relatively high temperature environment of cabinet 120 (e.g., an environment above 32° Fahrenheit).

A water valve 188 may be provided along brew conduit 184 to control the flow of water therethrough. For instance, water valve 188 may be in operable communication (e.g., electrically coupled) with controller 150. During use, water may be flowed (e.g., as directed by controller 150) from the water source to brew module 182. The brewing contents within the received brew pod may be mixed with water to create a beverage that is dispensed to the user. Water may thus exit refrigerator appliance 100 at brew module 182 as a desired brew or beverage mixture. Optionally, a suitable brew input or actuator (e.g., paddle, button, and/or sensor) of dispenser 132 may be used to initiate delivery of heated water through brew outlet 186.

In some such embodiments, the brew module 182 is removably mounted to dispensing assembly 130 in fluid communication between the brew conduit 184 and the dispenser recess 140. For instance, brew module 182 may define one or more slots to be received by corresponding flanges provided on top wall 160. In this manner, a user may slide brew module 182 into engagement with the flanges, which may hold brew module 182 in place. Alternatively, any other suitable removable mounting features may be provided.

In some embodiments, a filtration assembly 190 is provided along, or in fluid communication with, one or more conduits (e.g., conduits 170, 176, 184). For instance, filtration assembly 190 may be provided in fluid communication with chilled water conduit 170 upstream from chilled water outlet 172. Filtration assembly 190 may include a filtration cartridge supporting or holding a suitable filtration media, such as activated carbon granules, carbon blocks, filter paper sheets, mesh sheets, woven screens, melt blown polypropylene sheets, etc. Water through chilled water conduit 170 may thus be filtered before delivery to dispenser recess 140. In some such embodiments, one or more of doors (e.g., freezer door 112) defines a sub-compartment 192. For instance, sub-compartment 192 may be defined within freezer door 112 behind back panel 164 (e.g., between freezer chamber 116 and back panel 164 along the transverse direction T). In some such embodiments, back panel 164 further includes a movable compartment door 194 to selectively cover sub-compartment 192 and separate filtration assembly 190 from the rest of dispenser recess 140. Compartment door 194 may also be selectively moved (e.g., rotated) or removed to reveal sub-compartment 192 and permit access thereto. In turn, dispensing assembly 130 may advantageously provide access to filtration assembly 190 for certain tasks (e.g., replacement of filtration cartridge, etc.), while covering or hiding filtration assembly 190 during regular operation or use of dispensing assembly 130 (e.g., dispensing of water from chilled water outlet 172).

In further embodiments, dispensing assembly 130 may include a blender assembly 200. Accordingly, a motor 202 and blender container 204 may be provided at one of doors 110, 112. For instance, motor 202 may be mounted within refrigerator door 110 to selectively communicate with blender container 204 within dispenser recess 140. Blender container 204 may generally provide a removable fluid container enclosing one or more rotating blades 206. In some such embodiments, a driveshaft 208 may be provided (e.g., within blender container 204) for transmission of rotating force from motor 202 to blades 206. Blender container 204 may further include a collar 204 defining one or more slots to be received by corresponding flanges provided on top wall 160. In this manner, a user may blender container 204 into engagement with the flanges, which may hold blender container 204 in place. Alternatively, any other suitable removable mounting features may be provided.

As shown, in some embodiments, motor 202 is fixedly mounted within refrigerator door 110. For instance, motor 202 may be mounted in refrigerator door 110 (e.g., above top wall 160 and/or behind outer surface 122) to connect (e.g., mechanically couple) with blender container 204 and motivate rotation of driveshaft 208 and/or blades 206 therein. In turn, when refrigerator door 110 is in the closed position, motor 202 may be advantageously held adjacent to fresh food chamber 114, proximal to a relatively high temperature environment of cabinet 120 (e.g., an environment above 32° Fahrenheit).

Figure 7:
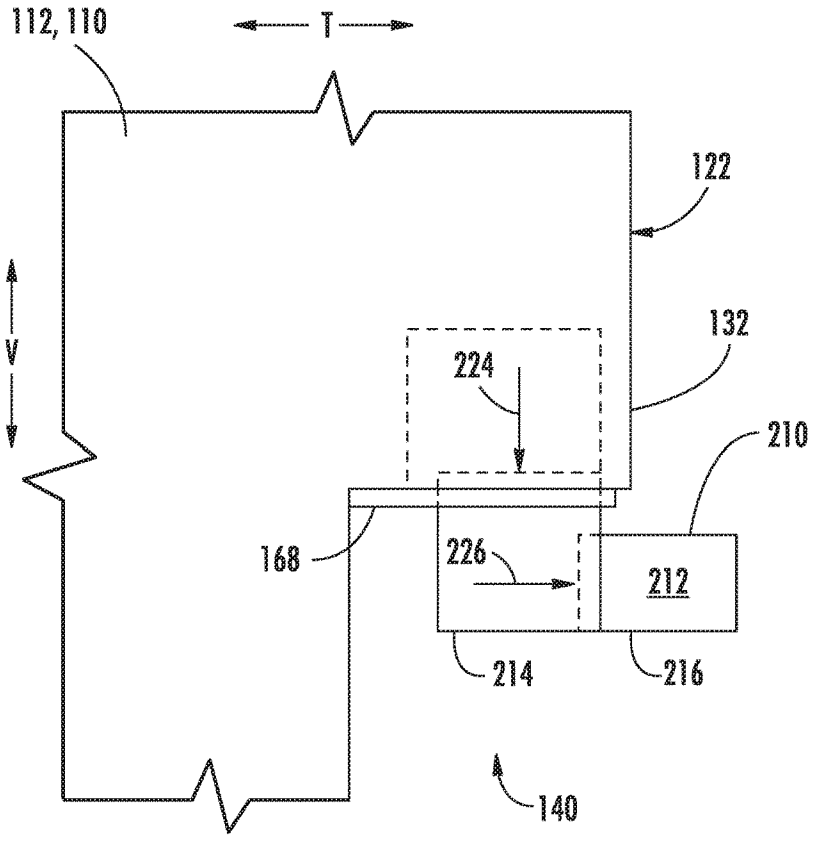
FIG. 7 provides a schematic side view of a top portion of the exemplary dispensing assembly of FIG. 6, wherein the dispenser drawer is shown in an extended position.
Figure 6:
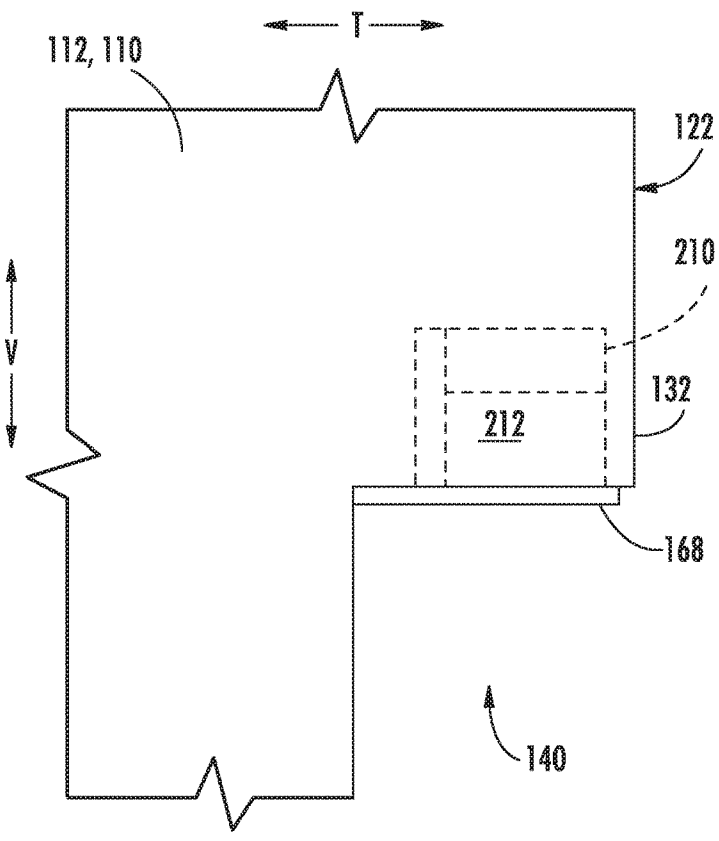
FIG. 6 provides a schematic side view of a top portion of a dispensing assembly according to exemplary embodiments of the present disclosure, wherein a dispenser drawer is shown in a recessed position.

Turning now to FIGS. 6 and 7, multiple schematic views are provided of an upper portion of optional embodiments of dispenser 132. As shown, some embodiments include one or more storage components, such as a dispenser drawer 210. Drawer 210 may be sized and configured, for example, to hold multiple brew pods for use with brew module 182 (FIG. 5). As shown, drawer 210 generally defines a storage cavity 212. Moreover, drawer 210 may be provided at or adjacent to top wall 160 in a corresponding door (e.g., 110 or 112). When assembled, drawer 210 may move between a closed position (FIG. 6) and an open position (FIG. 7). In the closed position, access to storage cavity 212 is restricted. Drawer 210 may also be hidden from view (e.g., above top wall 160 and behind outer surface 122). By contrast, in the open position, drawer 210 and storage cavity 212 may be revealed, permitting access thereto, even while the corresponding door (e.g., 110 or 112) is in its closed position (FIG. 1).

In some such embodiments, drawer 210 moves along at least two directions between the open position and the closed position. Specifically, drawer 210 may move along the vertical direction V and the transverse direction T. Drawer 210 may include a separate vertical frame 214 and horizontal frame 216 to direct such movement. When moving from the closed position to the open position, vertical frame 214 of drawer 210 may move (e.g., slide) vertically (as indicated at arrow 224) from a position above top wall 160 to a position below top wall 160. Subsequently, horizontal frame 216 of drawer 210 may move (e.g., slide) transversely (as indicated at arrow 226) to the open position wherein at least a portion of drawer 210 extends in front of the outer surface 122 of the corresponding door (e.g., 110 or 112). When moving from the open position to the closed position, it is understood that the reverse motions may be followed such that horizontal frame 216 of drawer 210 moves rearward along the transverse direction T before vertical frame 214 of drawer 210 moves upward along the vertical direction V.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet extending along the lateral direction from a first side portion to a second side portion, the cabinet defining a chilled chamber between the first side portion and the second side portion;

a door rotatably mounted to the cabinet to pivot between a closed position restricting access to the chilled chamber and an open position permitting access to the chilled chamber; and a dispensing assembly comprising a dispenser recess defined along an outer surface of the door and extending unrestricted in the lateral direction from the first side portion to the second side portion such that the dispenser recess communicates with the first side portion and the second side portion along the lateral direction, and an outlet conduit in selective fluid communication with the dispenser recess to direct a fluid thereto, wherein the door defines a sub-compartment, wherein the dispensing assembly further comprises a back panel extending along the vertical direction and defining one or more transverse extrema of the recess cavity, and wherein the back panel includes a movable compartment door positioned rearward from the outlet conduit and selectively permitting access to the sub-compartment through the dispenser recess;

a user interface panel provided on the door, wherein the user interface panel extends horizontally above the recess.

2. The refrigerator appliance of claim 1, further comprising an icemaker disposed within the cabinet, wherein the dispensing assembly further comprises an ice chute extending through the door to the dispenser recess in selective communication with the icemaker.

3. The refrigerator appliance of claim 1, wherein the outlet conduit is a chilled fluid conduit to direct a chilled fluid, and wherein the dispensing assembly further comprises a heated fluid conduit spaced apart from the chilled fluid conduit in selective fluid communication with the dispenser recess to direct a heated fluid thereto.

4. The refrigerator appliance of claim 1, further comprising a brew module to receive a brew pod, the brew module being removably mounted to the dispensing assembly in fluid communication between the outlet conduit and the dispenser recess.

5. The refrigerator appliance of claim 1, wherein the door is a first door rotatably mounted to the cabinet at the first side portion, wherein the refrigerator further comprises a second door rotatably mounted to the cabinet at the second side portion.

6. The refrigerator appliance of claim 5, wherein the chilled chamber is a fresh food chamber proximal to the second side portion, wherein the cabinet further comprises a freezer chamber proximal to the first side portion, and wherein the dispenser recess is further defined along the second door between the first side portion and the second side portion.

7. The refrigerator appliance of claim 5, wherein the outlet conduit is a chilled fluid conduit to direct a chilled fluid, wherein the dispensing assembly further comprises a heated fluid conduit spaced apart from the chilled fluid conduit in selective fluid communication with the dispenser recess to direct a heated fluid thereto, wherein the outlet conduit extends through the first door, and wherein the heated fluid conduit extends through the second door.

8. The refrigerator appliance of claim 1, further comprising a drawer selectively extending through a portion of the dispenser recess.

9. The refrigerator appliance of claim 1, further comprising a removable fluid container selectively received within the dispenser recess beneath the outlet conduit.

10. A refrigerator appliance defining a vertical direction, a lateral direction, and a transverse direction, the vertical, lateral, and transverse directions being mutually perpendicular, the refrigerator appliance comprising:

a cabinet extending along the lateral direction from a first side portion to a second side portion, the cabinet defining a freezer chamber and a fresh food chamber between the first side portion and the second side portion;

a first door rotatably mounted to the cabinet to pivot between a closed position restricting access to the freezer chamber and an open position permitting access to the freezer chamber;

a second door rotatably mounted to the cabinet to pivot between a closed position restricting access to the fresh food chamber and an open position permitting access to the fresh food chamber; and a dispensing assembly comprising a dispenser recess defined along an outer surface of the first door and an outer surface of the second door, the dispenser recess extending unrestricted in the lateral direction from the first side portion to the second side portion such that the dispenser recess communicates with the first side portion and the second side portion along the lateral direction, an outlet conduit in selective fluid communication with the dispenser recess to direct a fluid thereto; and a user interface panel extending horizontally above the recess, wherein the user interface panel is provided on the first door and the second door.

11. The refrigerator appliance of claim 10, further comprising an icemaker disposed within the cabinet, wherein the dispensing assembly further comprises an ice chute extending through the first door to the dispenser recess in selective communication with the icemaker.

12. The refrigerator appliance of claim 10, wherein the outlet conduit is a chilled fluid conduit to direct a chilled fluid, and wherein the dispensing assembly further comprises a heated fluid conduit spaced apart from the chilled fluid conduit in selective fluid communication with the dispenser recess to direct a heated fluid thereto.

13. The refrigerator appliance of claim 12, wherein the outlet conduit extends through the first door, and wherein the heated fluid conduit extends through the second door.

14. The refrigerator appliance of claim 10, further comprising a brew module to receive a brew pod, the brew module being removably mounted to the dispensing assembly in fluid communication between the outlet conduit and the dispenser recess.

15. The refrigerator appliance of claim 10, further comprising a drawer selectively extending through a portion of the dispenser recess.

16. The refrigerator appliance of claim 10, wherein the door defines a sub-compartment, wherein the dispensing assembly further comprises a back panel extending along the vertical direction and defining a transverse extreme of the recess cavity, and wherein the back panel includes a movable compartment door selectively permitting access to the sub-compartment through the dispenser recess.

17. The refrigerator appliance of claim 10, further comprising a removable fluid container selectively received within the dispenser recess beneath the outlet conduit.

* * * * *